US007559319B2

(12) United States Patent
Idogawa et al.

(10) Patent No.: US 7,559,319 B2
(45) Date of Patent: Jul. 14, 2009

(54) IGNITION COIL APPARATUS FOR AN INTERNAL COMBUSTION ENGINE

(75) Inventors: Takashi Idogawa, Chiyoda-ku (JP); Takeshi Shimizu, Chiyoda-ku (JP); Shigemi Murata, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 12/054,993

(22) Filed: Mar. 25, 2008

(65) Prior Publication Data

US 2009/0084369 A1 Apr. 2, 2009

(30) Foreign Application Priority Data

Oct. 2, 2007 (JP) ..... 2007-258536

(51) Int. Cl.
*F02P 3/04* (2006.01)

(52) U.S. Cl. ..... 123/652; 123/655; 123/638

(58) Field of Classification Search ..... 123/636, 123/638, 650, 652, 655, 656
See application file for complete search history.

(56) References Cited

U.S. PATENT DOCUMENTS 5,675,072 A * 10/1997 Yasuda et al. ..... 73/35.08
6,118,276 A * 9/2000 Nakata et al. ..... 324/464
6,216,530 B1 4/2001 Shimizu et al.
6,222,368 B1 * 4/2001 Inagaki et al. ..... 324/399
6,348,797 B1 * 2/2002 Shimizu et al. ..... 324/399
6,539,930 B2 * 4/2003 Inagaki ..... 123/655
6,705,302 B2 * 3/2004 Meinders ..... 123/620
6,779,517 B2 * 8/2004 Sakakura ..... 123/630
7,137,385 B2 * 11/2006 Newton ..... 123/630

FOREIGN PATENT DOCUMENTS

JP 2000-205034 A 7/2000

* cited by examiner

*Primary Examiner*—Erick Solis
(74) *Attorney, Agent, or Firm*—Sughrue Mion, PLLC

(57) ABSTRACT

An ignition coil apparatus for an internal combustion engine with a cylinder having first and second spark plugs can reliably detect an ionic current without discharging a bias voltage even at the start of supplying a primary current. The apparatus includes a coil member with primary and secondary coils. The secondary coil has first and second ends connected to the spark plugs through high voltage output terminals, respectively. A first diode has its anode connected to a capacitor, and its cathode connected between the first end of the secondary coil, at which a high positive voltage is generated upon interruption of the primary current, and a high voltage output terminal at a secondary coil first end side. A second diode has its anode connected to the secondary coil first end, and its cathode connected to a junction between the first diode and the high voltage output terminal.

2 Claims, 6 Drawing Sheets

IGNITION COIL APPARATUS FOR AN INTERNAL COMBUSTION ENGINE

BACKGROUND OF THE INVENTION

1. Field of the Invention

The present invention relates to an ignition coil apparatus for an internal combustion engine that includes an ionic current detection unit for detecting, as an ionic current, the ions generated by the combustion of an air fuel mixture in each cylinder of the internal combustion engine, 2. Description of the Related Art In recent years, there has been proposed a simultaneous ignition system that is designed to ignite a plurality of spark plugs at the same time by applying a high voltage for ignition to the plurality of spark plugs by means of a single ignition coil in order to achieve the reduction in the arrangement space of the ignition coil as well as the reduction in the production cost.

As one example of such a simultaneous ignition system, there is enumerated a combustion state detection apparatus for an internal combustion engine in which a high voltage for ignition is applied by means of one ignition coil to two spark plugs respectively arranged for two cylinders different from each other (see, for example, a first patent document: Japanese patent application laid-open No. 2000-205034).

The above-mentioned conventional apparatus is provided with the ignition coil (coil member), the spark plugs, a bias unit, a discharge current limiting unit, an ionic current detection unit, and an ECU (electronic control unit).

The ignition coil has a primary coil or winding and a secondary coil or winding, and generates a high voltage for ignition. The high ignition voltage thus generated is applied to the spark plugs. The bias unit is charged with a bias voltage of a positive polarity for detecting the ions generated by the combustion of an air fuel mixture in each of the engine cylinders. The discharge current limiting unit discharges the bias voltage thus charged to the bias unit. The ionic current detection unit detects the ions generated by the combustion of the air fuel mixture as an ionic current that flows through the spark plugs. The ECU detects a combustion state in each of the spark plugs based on the detected value of the ionic current.

Here, note that the discharge current limiting unit is arranged between an ignition current path, which extends from the secondary coil of the ignition coil to the spark plugs, and the bias unit.

In the above-mentioned conventional apparatus, the bias unit is charged by a voltage generated in the primary coil of the ignition coil at the instant when a primary current supplied to the primary coil is cut or interrupted. In addition, at this time, a high voltage for ignition is generated in the secondary coil. When combustion is generated by the high ignition voltage applied to the spark plugs in the cylinders immediately after the bias unit has been charged, the ionic current detection unit detects the ions generated in the cylinders as an ionic current.

Also, in recent years, there has been proposed a multi-point ignition system in which a plurality of spark plugs are installed for each of cylinders of an internal combustion engine and are ignited at a multiplicity of points within each cylinder in order to improve the combustion efficiency of the internal combustion engine.

Accordingly, it is considered that an ignition apparatus is constructed to have a multi-point ignition system by installing, on one cylinder, two spark plugs which are mounted on two mutually different cylinders, respectively, in the above-mentioned conventional apparatus.

In such an ignition apparatus, the ionic current detection unit can detect an ionic current through either of the spark plugs that are connected to a positive polarity side and a negative polarity side, respectively, of a secondary coil of the ignition coil.

In this ignition apparatus, when a primary current is started to be supplied to a primary coil of the ignition coil, there is generated in the secondary coil a voltage of a polarity opposite to the polarity of a voltage which is generated upon interruption of the primary current. That is, a voltage of a negative polarity (i.e., opposite to the direction or polarity of a regular bias voltage) is applied to the bias unit, and the bias voltage charged to the bias unit is discharged through the discharge current limiting unit.

In the above-mentioned ignition apparatus, at the instant when the primary current is started to be supplied to the primary coil, the negative polarity voltage is applied to the bias unit, whereby the bias voltage is discharged from the bias unit.

Therefore, there has been a problem that until the time when the bias unit has been recharged after the primary current is again interrupted, an ionic current can not be detected, and hence a combustion state in each of the spark plugs can not be detected, either.

SUMMARY OF THE INVENTION

Accordingly, the present invention is intended to solve the problem as referred to above, and has for its object to provide an ignition coil apparatus for an internal combustion engine that can detect an ionic current in a reliable manner without discharging a bias voltage even at the instant when a primary current is started to be supplied to an ignition coil in the internal combustion engine provided with a cylinder having a plurality of spark plugs.

Bearing the above object in mind, an ignition coil apparatus for an internal combustion engine provided with a cylinder having a plurality of spark plugs according to the present invention includes: a coil member having a primary coil and a secondary coil; a switching unit that serves to selectively supply and interrupt a primary current for the primary coil; a bias unit that is charged with a voltage generated in the primary coil as a bias voltage upon interruption of the primary current; an ionic current detection unit that detects, as an ionic current, ions generated by the combustion of an air fuel mixture in the cylinder; a first diode that serves to protect the ionic current detection unit; and a second diode that serves to prevent the bias voltage from being discharged at the instant when the primary current is started to be supplied to the primary coil. The primary coil has one end thereof connected to a battery, and at the same time the other end thereof connected to the switching unit. The secondary coil has a first end and a second end thereof connected to the plurality of spark plugs, respectively, through individual high voltage output terminals. The first diode has an anode thereof connected to the bias unit, and the first diode has a cathode thereof connected between the first end of the secondary coil, at which a high voltage of a positive polarity is generated upon interruption of the primary current, and a high voltage output terminal at a side of the first end side of the secondary coil. The second diode has an anode thereof connected to the first end of the secondary coil, and the second diode has a cathode thereof connected to a junction between the first diode and the high voltage output terminal at a side of the first end of the secondary coil.

According to the ignition coil apparatus for an internal combustion engine provided with a cylinder having a plurality of spark plugs according to the present invention, the second diode has its anode connected to the first end of the secondary coil of the coil member, and its cathode connected to the junction between the first diode and the high voltage output terminal at the first end side of the secondary coil. With such an arrangement, even if at the start of supplying a primary current to the ignition coil, there is generated in the secondary coil a voltage of a polarity opposite to the polarity of a voltage that is generated upon interruption of the primary current, the discharging of a bias voltage is inhibited by the second diode.

Thus, even at the start of supplying the primary current, an ionic current can be detected in a reliable manner without discharging the bias voltage.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Figure 1:
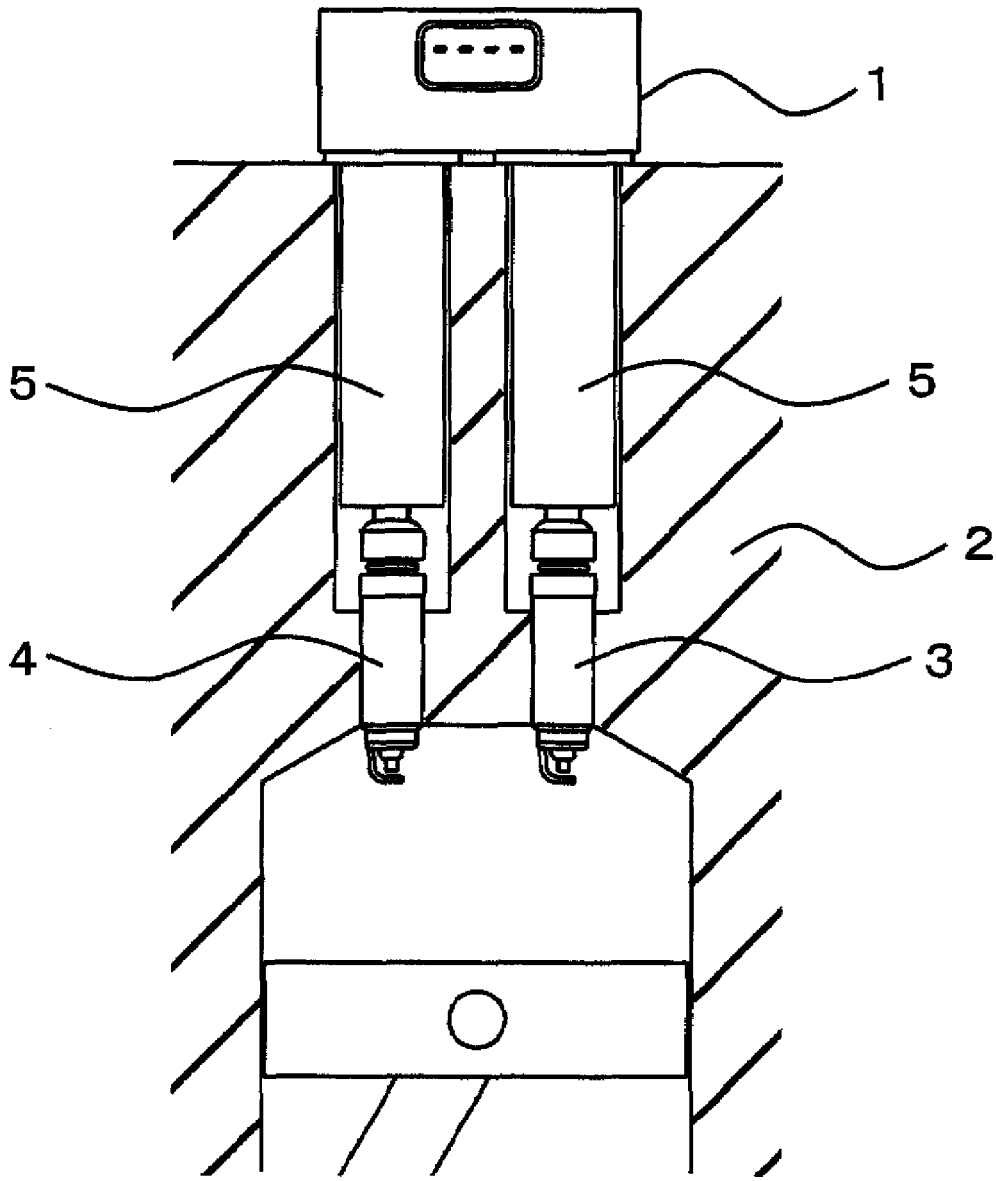
FIG. 1 is a cross sectional view showing that an ignition coil apparatus for an internal combustion engine according to a first embodiment of the present invention is mounted on a cylinder.

Now, preferred embodiments of the present invention will be described in detail while referring to the accompanying drawings. Throughout respective figures, the same or corresponding members or parts are identified by the same reference numerals and characters.

Here, note that in the following embodiments, reference will be made to a case where an ignition coil apparatus for an internal combustion engine is installed on a vehicle.

Embodiment 1

Referring to the drawings and first to FIG. 1, there is shown, in a cross sectional view, an ignition coil apparatus 1 for an internal combustion engine (hereinafter abbreviated as an "ignition coil apparatus 1") according to a first embodiment of the present invention, which is mounted on a cylinder 2.

In FIG. 1, a first spark plug 3, a second spark plug 4, and the ignition coil apparatus 1 are arranged at a top portion of the cylinder 2. The first spark plug 3 and the second spark plug 4 are arranged in the single cylinder 2.

The first spark plug 3 and the second spark plug 4 fire a mixture in the cylinder 2. The ignition coil apparatus 1 applies a high ignition voltage to the first spark plug 3 and the second spark plug 4. In addition, a pair of plug boots 5 formed of an elastic material for example are fitted to the first spark plug 3 and the second spark plug 4, respectively.

Figure 2:
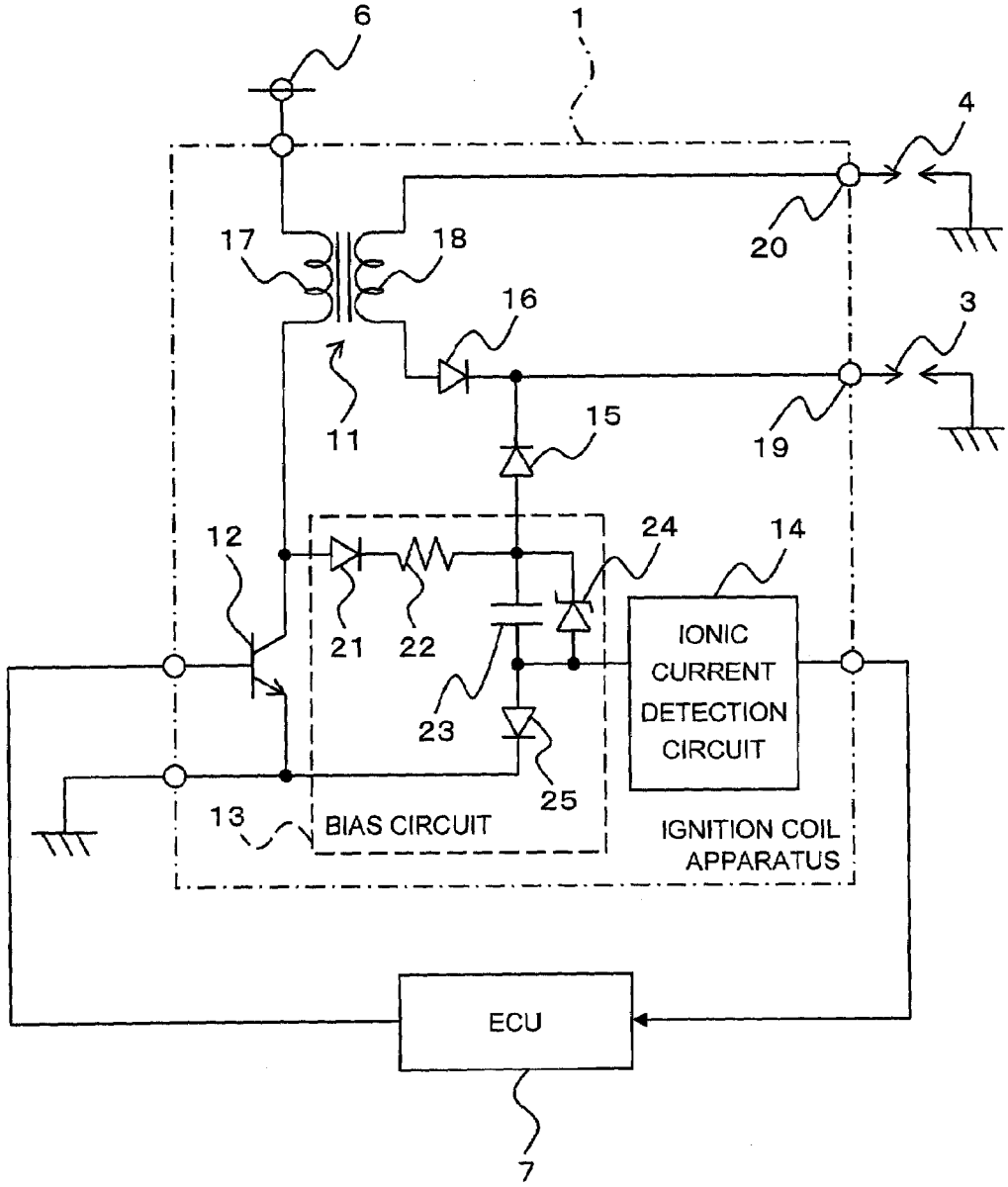
FIG. 2 is a circuit diagram showing the ignition coil apparatus for an internal combustion engine according to the first embodiment of the present invention together with its peripheral equipment.

FIG. 2 is a circuit diagram that shows the ignition coil apparatus 1 according to the first embodiment of the present invention together with its peripheral equipment.

In FIG. 2, the first spark plug 3, the second spark plug 4, a battery 6 and an ECU 7 are connected to the ignition coil apparatus 1. In addition, the ignition coil apparatus 1 is connected to the ground.

The ignition coil apparatus 1 includes a coil member 11, a power transistor 12 (a switching unit), a bias circuit 13, an ionic current detection circuit 14 (an ionic current detection unit), a first diode 15 and a second diode 16.

The coil member 11 has a primary coil 17 and a secondary coil 18. The primary coil 17 has one end thereof connected to the battery 6, and the other end thereof connected to the ground through the power transistor 12. The secondary coil 18 has opposite ends thereof connected to the first spark plug 3 and the second spark plug 4 through a first high voltage output terminal 19 and a second high voltage output terminal 20, respectively.

The plug boots 5 are fitted to the first high voltage output terminal 19 and the second high voltage output terminal 20, respectively. The first high voltage output terminal 19 and the second high voltage output terminal 20 are connected to the first spark plug 3 and the second spark plug 4 through the plug boots 5, respectively.

In addition, the primary coil 17 and the secondary coil 18 are magnetically coupled with each other to constitute a transformer.

The power transistor 12 serves to supply and interrupt the primary current to the primary coil 17 in accordance with a drive signal (to be described later) from the ECU 7.

Here, note that when the primary current to the primary coil 17 is interrupted, a voltage of a positive polarity is generated at a power transistor 12 side of the primary coil 17, and a voltage of a negative polarity is generated at a battery 6 side of the primary coil 17, under the action of self induction.

Also, at this time, a high voltage (e.g., several tens kV) of a polarity corresponding to that of the primary coil 17 is generated in the secondary coil 18 under the action of mutual induction. That is, a high voltage of a positive polarity is generated at a first spark plug 3 side of the secondary coil 18, and a high voltage of a negative polarity is generated at a second spark plug 4 side of the secondary coil 18.

Here, note that at the instant when the primary current is started to be supplied to the primary coil 17, voltages of polarities opposite to the polarities of the voltages which are generated upon interruption of the primary current are generated in the primary coil 17 and the secondary coil 18, respectively.

The bias circuit 13 includes a rectifier diode 21, a resistor 22, a capacitor 23 (a bias unit), a Zener diode 24 and a rectifier diode 25.

The rectifier diode 21 is connected between the primary coil 17 and the power transistor 12. The resistor 22 is connected in series to the rectifier diode 21 for limiting a current passing therethrough. The capacitor 23 is connected in series to the resistor 22. The Zener diode 24 is connected in parallel to the capacitor 23 for limiting a voltage thereacross. The rectifier diode 25 has one end thereof connected in series to the capacitor 23, and the other end thereof connected to the ground.

A voltage of a positive polarity, having been generated upon interruption of the primary current under the action of the self induction of the primary coil 17, is applied to the capacitor 23. The capacitor 23 is charged to a predetermined bias voltage (e.g., about several hundred bolts) by a clamping voltage of the Zener diode 24, and functions as a power supply for detecting an ionic current. That is, the capacitor 23 is charged up to an avalanche voltage of the Zener diode 24 by means of the voltage generated upon interruption of the primary current, and ensures a bias voltage necessary for the detection of an ionic current.

The ionic current detection circuit 14 detects, as an ionic current, the ions generated by the combustion of an air fuel mixture in the cylinder 2. In addition, the ionic current detection circuit 14 outputs the detected ionic current to the ECU 7 as an ionic current detection signal.

The first diode 15 is arranged between the secondary coil 18 and the capacitor 23. In addition, the first diode 15 is connected in such a manner that the direction in which the ionic current flows becomes forward. That is, the first diode 15 has an anode thereof connected to a positive polarity side of the capacitor 23, and a cathode thereof connected between an end (first end) of the secondary coil 18 near the first spark plug 3 and the first high voltage output terminal 19.

Here, as stated before, when the primary current is interrupted, a high voltage of a positive polarity is generated at the first spark plug 3 side of the secondary coil 18, and a high voltage of a negative polarity is generated at the second spark plug 4 side of the secondary coil 18. That is, upon interruption of the primary current, an ignition current (secondary current) flows from the second spark plug 4 to the first spark plug 3 via the secondary coil 18.

The first diode 15 serves to prevent the ignition current from flowing into the ionic current detection circuit 14, whereby a high voltage is prevented from being applied to the ionic current detection circuit 14.

The second diode 16 is arranged between the first diode 15 and the secondary coil 18. In addition, the second diode 16 is connected in such a manner that the direction in which the ignition current flows becomes forward. That is, the second diode 16 has an anode thereof connected to an end of the secondary coil 18 near the first spark plug 3, and a cathode connected to a junction between the first diode 15 and the first high voltage output terminal 19.

Here, as previously stated, when the primary current is started to be supplied to the primary coil 17, a high voltage of a negative polarity is generated at the first spark plug 3 side of the secondary coil 18, and a high voltage of a positive polarity is generated at the second spark plug 4 side of the secondary coil 18.

The second diode 16 serves to prevent the discharge of the bias voltage, which has been charged to the capacitor 23 by means of the high voltage of the negative polarity generated at the first spark plug 3 side of the secondary coil 18.

The ionic current detection signal is input from the ionic current detection circuit 14 to the ECU 7, and other signals indicating various engine operating states are also input to the ECU 7 from a variety of kinds of sensors (not shown).

Based on the ionic current detection signal and the engine operating states, the ECU 7 detects the combustion state of the internal combustion engine, calculates ignition timing and the like, and outputs a drive signal to the power transistor 12.

Here, note that the ECU 7 is constituted by a microprocessor (not shown) including a CPU and a memory with programs stored therein.

Now, the operation of the ignition coil apparatus I as constructed above will be explained below.

First of all, the ECU 7 generates the drive signal to the power transistor 12 based on the ionic current detection signal and the engine operating states, and outputs it to a base of the power transistor 12.

The power transistor 12 is driven to supply and interrupt the primary current to the primary coil 17 in accordance with the drive signal from the ECU 7.

Here, when the primary current is interrupted, a voltage of a positive polarity is generated at the power transistor 12 side of the primary coil 17.

At this time, the capacitor 23 is charged to the predetermined bias voltage by means of the voltage of the positive polarity generated in the primary coil 17.

In addition, when the primary current is interrupted, a high voltage of a positive polarity is generated at the first spark plug 3 side of the secondary coil 18, and a high voltage of a negative polarity is generated at the second spark plug 4 side of the secondary coil 18.

At this time, an ignition current flows from the second spark plug 4 to the first spark plug 3 via the secondary coil 18, and the high ignition voltages of mutually opposite polarities are applied to the first spark plug 3 and the second spark plug 4, respectively.

Figure 3:
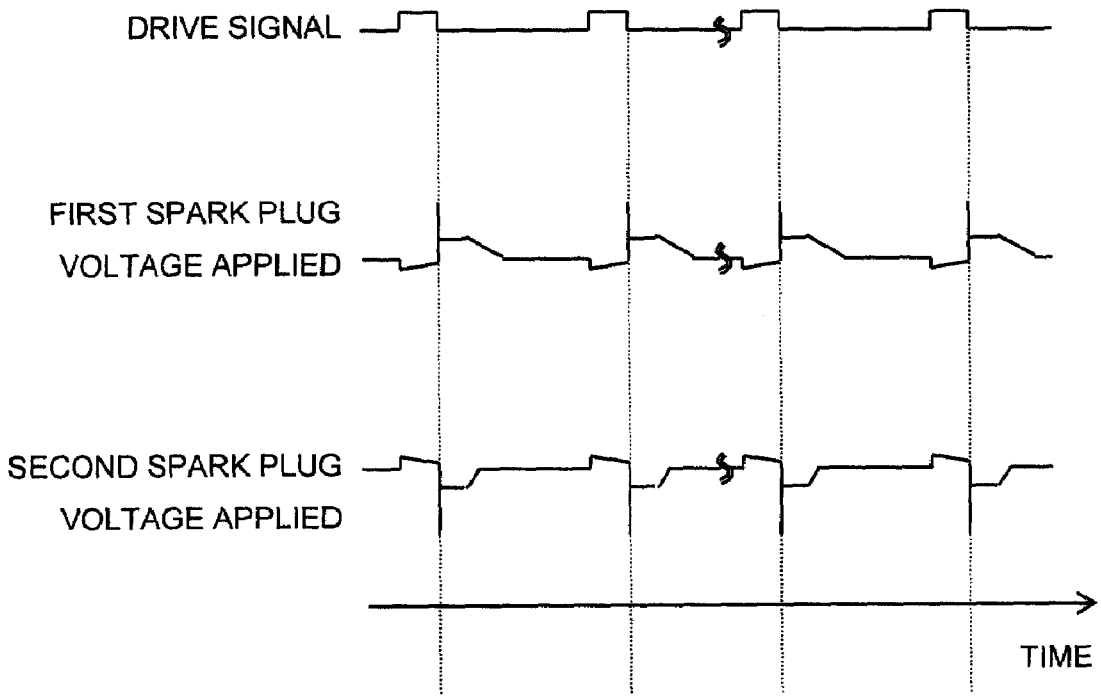
FIG. 3 is a timing chart showing the relation between a drive signal supplied to a power transistor and high voltages applied to a first spark plug and a second spark plug according to the first embodiment of the present invention.

The relation between the drive signal input to the power transistor 12 and the high voltages applied to the first spark plug 3 and the second spark plug 4, respectively, is shown in FIG. 3.

Subsequently, when the combustion of the air fuel mixture in the cylinder 2 is produced by the high ignition voltages thus applied to the first spark plug 3 and the second spark plug 4, the bias voltage charged to the capacitor 23 is applied to the first spark plug 3 through the first diode 15, whereby the ionic current detection circuit 14 detects an ionic current flowing through the first spark plug 3.

On the other hand, when the primary current is started to be supplied to the primary coil 17, a high voltage of a negative polarity is generated at the first spark plug 3 side of the secondary coil 18, and a high voltage of a positive polarity is generated at the second spark plug 4 side of the secondary coil 18.

Here, the second diode 16 is arranged between the first diode 15 and the secondary coil 18, so the bias voltage charged to the capacitor 23 is prevented from being discharged.

At this time, the bias voltage charged to the capacitor 23 is applied to the first spark plug 3 through the first diode 15, and the ionic current detection circuit 14 detects an ionic current flowing through the first spark plug 3.

It is to be noted that because the second diode 16 is connected in such a manner that the direction in which the ignition current flows becomes forward, the ignition characteristic or quality is not deteriorated by the second diode 16.

Here, in case where no provision is made for the second diode 16, it is necessary to connect a resistor in series with the first diode 15 in order to prevent a large current from flowing through the first diode 15 due to a high voltage generated in the secondary coil 18 at the start of supplying the primary current.

In this regard, it is considered that this resistor, being arranged in a path in which an ionic current is detected, deteriorates the detectability of the ionic current.

However, in the ignition coil apparatus 1 according to this embodiment, there is no need to connect a resistor in series with the first diode 15 because the second diode 16 is arranged between the first diode 15 and the secondary coil 18. Accordingly, there is no loss due to such a resistor, and the detectability of the ionic current is not deteriorated at all. In addition, there is no increase in the number of component parts.

According to the ignition coil apparatus 1 of the first embodiment of the present invention, in the internal combustion engine provided with the cylinder 2 having the first spark plug 3 and the second spark plug 4, the anode of the second diode 16 is connected to one end of the secondary coil 18 near the first spark plug 3, and the cathode of the second diode 16 is connected to the junction between the first diode 15 and the first high voltage output terminal 19.

With such an arrangement, even if at the start of supplying a primary current to the ignition coil, there is generated in the secondary coil 18 a voltage of a polarity opposite to the polarity of a voltage that is generated upon interruption of the primary current, the discharging of the bias voltage is inhibited by the second diode 16.

Thus, even at the start of supplying the primary current, the ionic current can be detected in a reliable manner without discharging the bias voltage.

In addition, because the ionic current can be detected even at the start of supplying the primary current, it is possible to detect pre-ignition in which the air fuel mixture in the cylinder 2 starts to burn in a spontaneous manner due to a rise in the temperature of the cylinder 2 before it is fired by the spark plugs 3, 4. Also, it is possible to detect an event in which the spark plugs 3, 4 are driven to ignite erroneously by means of a voltage of an opposite polarity that is generated immediately after the start of supply of the primary current.

Moreover, the plug boots 5 are fitted to the first high voltage output terminal 19 and the second high voltage output terminal 20, respectively, so that the first high voltage output terminal 19 and the second high voltage output terminal 20 are connected to the first spark plug 3 and the second spark plug 4 through the plug boots 5, respectively.

As a result, the ionic current can be detected in a more reliable manner by reducing the influence of the thermal expansion of the spark plugs 3, 4, the loss of the ionic current, and noise that is superposed on the ionic current.

Although in the above-mentioned first embodiment, the plug boots 5 are fitted to the first high voltage output terminal 19 and the second high voltage output terminal 20, respectively, the present invention is not limited to this.

Figure 4:
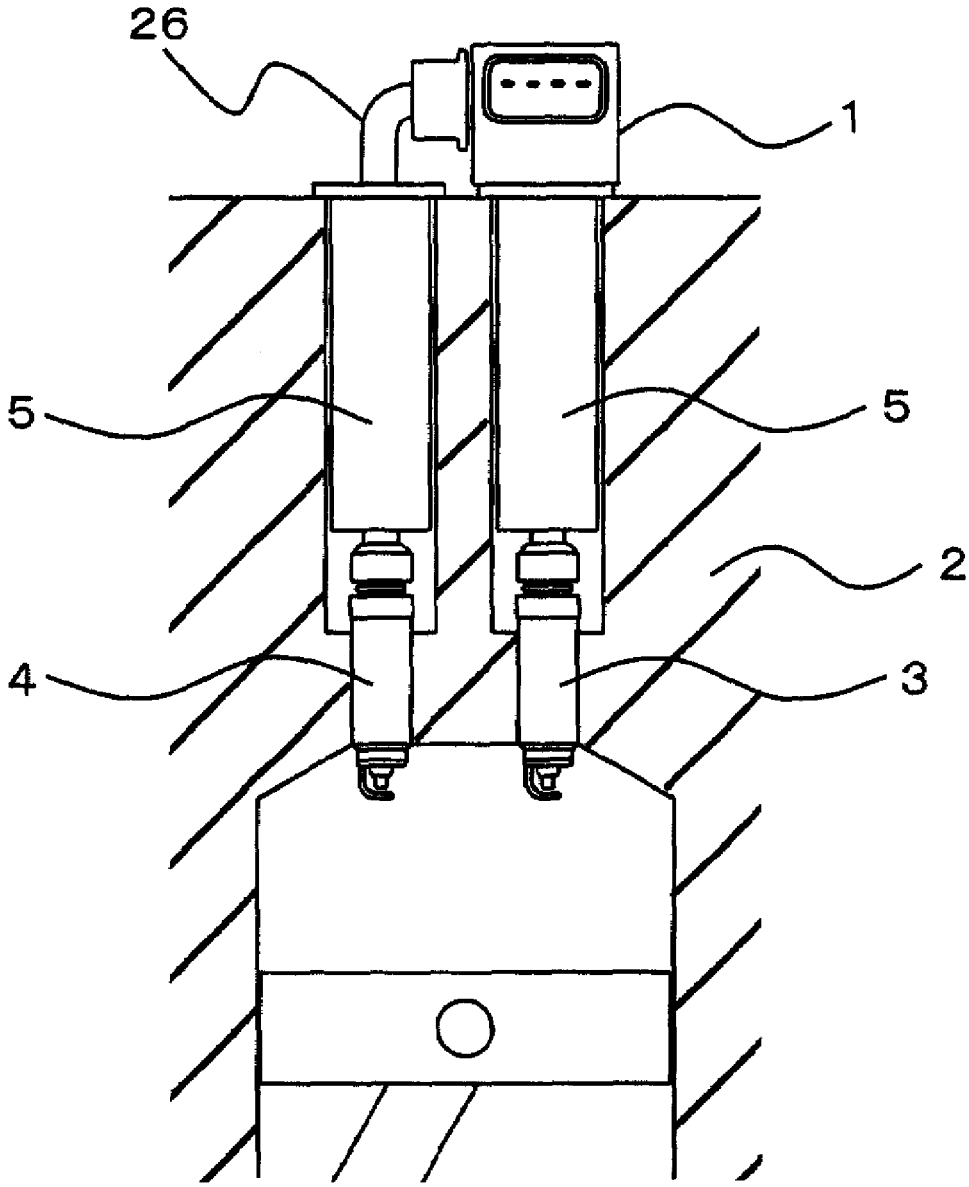
FIG. 4 is a cross sectional view showing that a first modified form of the ignition coil apparatus for an internal combustion engine according to the first embodiment of the present invention is mounted on a cylinder.

For example, as shown in FIG. 4, a plug boot 5 may be directly fitted to a first high voltage output terminal (refer to 19 in FIG. 2) alone which is used for detecting an ionic current, so that the first high voltage output terminal is connected to the first spark plug 3 through the plug boot 5. At this time, a second high voltage output terminal (refer to 20 in FIG. 2) may be connected through a high voltage cable 26 to a second spark plug 4 to which another plug boot 5 is fitted.

In this case, the ionic current can be detected in a reliable manner, and a reduction in cost can be achieved.

Further, instead of using the high voltage cable 26, it is possible to achieve the cost reduction by connecting the second high voltage output terminal 20 and the second spark plug 4 to each other while simplifying connector terminals.

Although in the above-mentioned first embodiment, the first spark plug 3 and the second spark plug 4 connected to the ignition coil apparatus 1 are arranged for the single cylinder 2, the present invention is not limited to this.

Figure 5:
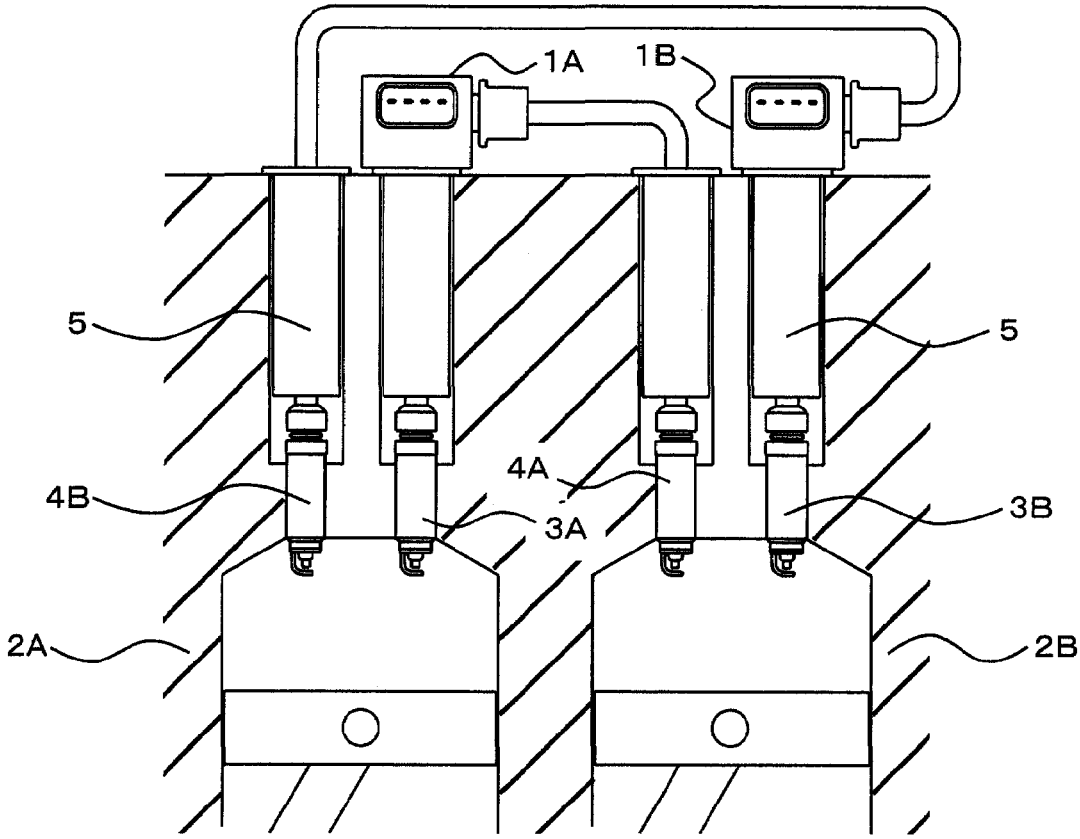
FIG. 5 is a cross sectional view showing that a second modified form of the ignition coil apparatus for an internal combustion engine according to the first embodiment of the present invention is mounted on a cylinder.

For example, as shown in FIG. 5, a first spark plug 3A and a second spark plug 4A, which are connected to a first ignition coil apparatus 1A, may be provided for a first cylinder 2A and a second cylinder 2B, respectively, and a first spark plug 3B and a second spark plug 4B, which are connected to a second ignition coil apparatus 1B, may be provided for the second cylinder 2B and the first cylinder 2A, respectively.

In addition, in such a construction, the input timing of a drive signal input to a first power transistor 12A (refer to 12 in FIG. 2) of the first ignition coil apparatus 1A and the input timing of a drive signal input to a second power transistor 12B (refer to 12 in FIG. 2) of the second ignition coil apparatus 1B may be displaced or shifted from each other. At this time, there arises a phase difference between the ignition timings in the first and second cylinders 2A, 2B.

Figure 6:
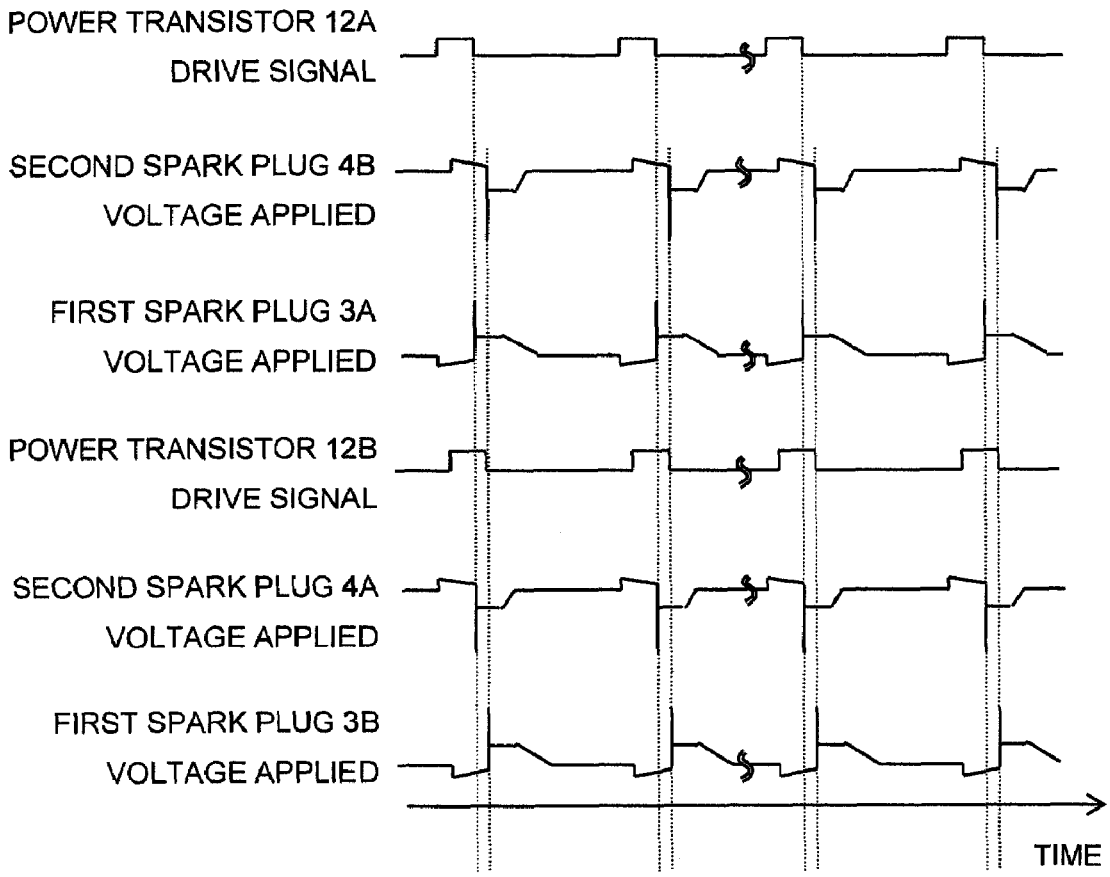
FIG. 6 is a timing chart showing the relation among drive signals supplied to power transistors and high voltages applied to first spark plugs and second spark plugs according to the second modified form of the first embodiment of the present invention.

The relation among the drive signals input to the power transistors 12A, 12B and high voltages applied to the first spark plugs 3A, 3B and the second spark plugs 4A, 4B, respectively, is shown in FIG. 6.

In this case, the combustion state of the internal combustion engine can be improved to enhance the combustion efficiency thereof by controlling the phase difference between the ignition timings in the first and second cylinders 2A, 2B in accordance with the engine operating states such as the number of revolutions per minute of the internal combustion engine, etc.

While the invention has been described in terms of preferred embodiments, those skilled in the art will recognize that the invention can be practiced with modifications within the spirit and scope of the appended claims.

What is claimed is:

1. An ignition coil apparatus for an internal combustion engine provided with a cylinder having a plurality of spark plugs, the apparatus comprising:

a coil member having a primary coil and a secondary coil;

a switching unit that serves to selectively supply and interrupt a primary current for the primary coil;

a bias unit that is charged with a voltage generated in the primary coil as a bias voltage upon interruption of the primary current;

an ionic current detection unit that detects, as an ionic current, ions generated by the combustion of an air fuel mixture in the cylinder;

a first diode that serves to protect the ionic current detection unit; and a second diode that serves to prevent the bias voltage from being discharged at the instant when the primary current is started to be supplied to the primary coil;

wherein the primary coil has one end thereof connected to a battery, and at the same time the other end thereof connected to the switching unit;

the secondary coil has a first end and a second end thereof connected to the plurality of spark plugs, respectively, through individual high voltage output terminals;

the first diode has an anode thereof connected to the bias unit;

the first diode has a cathode thereof connected between the first end of the secondary coil, at which a high voltage of a positive polarity is generated upon interruption of the primary current, and a high voltage output terminal at a side of the first end side of the secondary coil;

the second diode has an anode thereof connected to the first end of the secondary coil; and the second diode has a cathode thereof connected to a junction between the first diode and the high voltage output terminal at a side of the first end of the secondary coil.

2. The ignition coil apparatus for an internal combustion engine as set forth in claim 1, wherein a plug boot is directly fitted to the high voltage output terminal at a side of the first end of the secondary coil and is connected to the spark plugs.

* * * * *